US012195058B1

(12) United States Patent
Fang et al.

(10) Patent No.: US 12,195,058 B1
(45) Date of Patent: Jan. 14, 2025

(54) AUXILIARY TRANSPORTATION SYSTEM FOR DIESEL ENGINE MONORAIL CRANE LOCOMOTIVE IN SLOPE AND CONTROL METHOD

(71) Applicant: Ningxia Wangwa Coal Industry Co., LTD, Guyuan (CN)

(72) Inventors: Yunmai Fang, Guyuan (CN); Jing Xie, Guyuan (CN); Qiang Zhao, Guyuan (CN); Liangliang Zhao, Guyuan (CN); Peiwen Huang, Guyuan (CN)

(73) Assignee: NINGXIA WANGWA COAL INDUSTRY CO., LTD, Guyuan (CN)

( * ) Notice: Subject to any disclaimer, the term of this patent is extended or adjusted under 35 U.S.C. 154(b) by 0 days.

(21) Appl. No.: 18/788,513

(22) Filed: Jul. 30, 2024

(30) Foreign Application Priority Data

Aug. 15, 2023 (CN) ..... 202311021881.0

(51) Int. Cl.
*B61B 13/04* (2006.01)
*B61J 3/00* (2006.01)

(52) U.S. Cl.
CPC ..... *B61J 3/00* (2013.01); *B61B 13/04* (2013.01)

(58) Field of Classification Search
CPC .... B61B 3/00; B61B 3/02; B61B 5/00; B61B 13/04; B61B 13/06; E21F 13/00; E21F 13/006; E21F 13/008; B61J 3/00
See application file for complete search history.

(56) References Cited

U.S. PATENT DOCUMENTS 2,743,830 A * 5/1956 Bares ..... E21F 13/04 414/565
4,979,780 A * 12/1990 Marion ..... E21C 41/22 299/11

(Continued)

FOREIGN PATENT DOCUMENTS

AT 328262 B 3/1976
CN 201193039 Y 2/2009

(Continued)

*Primary Examiner* — Robert J McCarry, Jr.
(74) *Attorney, Agent, or Firm* — MUNCY, GEISSLER, OLDS & LOWE, P.C.

(57) ABSTRACT

Disclosed in the present application are an auxiliary transportation system for a diesel engine monorail crane locomotive in a slope and a control method thereof, relating to the field of auxiliary transportation technologies in a mine shaft. The system includes: a roadway, where a monorail crane track is arranged at a top end of the roadway; and a transfer transportation device, where the transfer transportation device runs on the monorail crane track, and a first sensing control unit is integrated in the transfer transportation device. The roadway includes an auxiliary slope mouth, the first-level to an $N^{th}$-level upper auxiliary slope bodies, the first-level to an $N^{th}$-level lower auxiliary slope bodies, the first-level to an $N^{th}$-level auxiliary slope central stations, a plurality of arc-shaped shaft bodies, and an auxiliary slope bottom. A plurality of transfer transportation devices can run simultaneously in an auxiliary slope body designed in the present application, to implement simultaneous upward or downward transportation of the plurality of transfer transportation devices, thereby improving scheduling and transportation efficiency, and greatly meeting a requirement of a large transportation volume of materials in slope bodies.

10 Claims, 1 Drawing Sheet

(56) References Cited

U.S. PATENT DOCUMENTS

| | | | | |
|---|---|---|---|---|
| 2014/0262219 | A1* | 9/2014 | Beddoes | E21C 41/24 175/57 |
| 2020/0198661 | A1* | 6/2020 | Kou | B61B 3/02 |
| 2021/0164349 | A1* | 6/2021 | Mapp | E21C 27/24 |

FOREIGN PATENT DOCUMENTS

| | | | | | |
|---|---|---|---|---|---|
| CN | 101857042 | A | | 10/2010 | |
| CN | 201713189 | U | * | 1/2011 | B66B 17/00 |
| CN | 102619557 | A | | 8/2012 | |
| CN | 103231976 | A | | 8/2013 | |
| CN | 211391226 | U | | 9/2020 | |
| CN | 212614746 | U | | 2/2021 | |
| CN | 113582022 | A | | 11/2021 | |
| CN | 115653672 | A | | 1/2023 | |
| DE | 10148971 | A1 | * | 4/2003 | A61G 1/00 |

* cited by examiner

AUXILIARY TRANSPORTATION SYSTEM FOR DIESEL ENGINE MONORAIL CRANE LOCOMOTIVE IN SLOPE AND CONTROL METHOD

TECHNICAL FIELD

The present application relate to the field of auxiliary transportation technologies in a mine shaft, and in particular to an auxiliary transportation system for a diesel engine monorail crane locomotive in a slope and a control method.

BACKGROUND

Transportation systems such as an electric locomotive, a monorail crane, and a transfer robot in a mine shaft are the main artery of an auxiliary transportation system in the mine shaft, and are important guarantees for the safe and efficient running of the transportation system. Currently, manners such as slope train hoisting, and gentle slope trackless rubber tyre vehicle transportation are used in auxiliary transportation systems of coal or non-coal mine shafts in most districts in China. However, these manners all have certain risks and deficiencies that need to be resolved urgently.

Potential rope breakage and slippage risks in slope train hoisting remain the shortcomings, pain points, and safety management difficulties of slope train hoisting. As a mine shaft keeps extending, a hoisting distance keeps increasing, and in addition, the floor heave of a roadway deforms. As a result, a transportation speed decreases, a transportation capability is insufficient, and a safety risk also increases correspondingly.

Gentle slope trackless rubber tyre vehicle transportation has characteristics such as no transfer, a wide application scope, a fast transportation speed, a strong transportation capability, and low transportation costs. However, when a coal seam is buried deep and a mining depth of a mine shaft is large, because a shaft body has an excessively large bevel length, the safety factor is correspondingly increased. In addition, the period of mine construction is excessively long, and a huge investment is required. Therefore, gentle slope trackless rubber tyre vehicle transportation is seldom used.

In addition, as shown in FIG. 1, only one line of locomotives are allowed to run once in a slope train hoisting development roadway, and in a shallow-depth linear mine shaft roadway using monorail crane transportation, to ensure safety, also only one line of locomotives are allowed to run once. Therefore, how to provide an intelligent transfer system that can efficiently implement underground transportation and a control method thereof is still a technical difficulty.

SUMMARY OF THE INVENTION

To resolve the technical problems discussed in the BACKGROUND, the present application provides an auxiliary transportation system for a diesel engine monorail crane locomotive in a slope and a control method.

The present application adopts the following technical solutions: An auxiliary transportation system for a diesel engine monorail crane locomotive in a slope, including: a roadway, where a monorail crane track is arranged at a top end of the roadway; and a transfer transportation device, where the transfer transportation device runs on the monorail crane track, and a first sensing control unit is integrated in the transfer transportation device, where the roadway includes:

an auxiliary slope mouth, where a first parking position is disposed at the auxiliary slope mouth, allowing parking of a particular quantity of transfer transportation devices to be run;

the first-level to an $N^{th}$-level upper auxiliary slope bodies, the levels of upper auxiliary slope bodies are arranged in stages, and each level of upper auxiliary slope body has:

an upper straight shaft body, where the upper straight shaft body has a gradient of 12° to 15° relative to a horizontal plane, only one line of transfer transportation devices are allowed to pass upward or downward inside the upper straight shaft body; and the first-level upper straight shaft body is in communication with the auxiliary slope mouth;

the first-level to an $N^{th}$-level lower auxiliary slope bodies, the levels of lower auxiliary slope bodies are arranged in stages, and each level of lower auxiliary slope body has:

a lower straight shaft body, where the lower straight shaft body is spatially parallel to the upper straight shaft body, each level of lower straight shaft body is arranged in a staggered manner obliquely below a corresponding level of upper straight shaft body, and only one line of transfer transportation devices are allowed to pass downward or upward inside the lower straight shaft body;

the first-level to an $N^{th}$-level auxiliary slope central stations, and each level of auxiliary slope central station has:

a straight crossover shaft body allowing two lines of transfer transportation devices that are staggered upward and downward to pass simultaneously, where each level of straight crossover shaft body is located between a level of upper straight shaft body and a level of lower straight shaft body that are adjacent and between the lower straight shaft body and a next level of upper straight shaft body that are adjacent; and a second sensing control unit is integrated inside each level of straight crossover shaft body;

a plurality of arc-shaped shaft bodies, connected between an auxiliary slope central station and an upper straight shaft body and between an auxiliary slope central station and a lower straight shaft body that are adjacent, so that the upper straight shaft body, the auxiliary slope central station, and the lower straight shaft body that are adjacent form a spatially Z-shaped or inverted Z-shaped arrangement, and a pair of auxiliary slope central stations connected to two sides of each level of upper straight shaft body or lower straight shaft body are spatially arranged in a centrosymmetric structure with the corresponding upper straight shaft body or lower straight shaft body as a center, where a third sensing control unit is integrated inside each arc-shaped shaft body, and is configured to: sense position information of the transfer transportation device running inside the arc-shaped shaft body and in the connected upper straight shaft body or lower straight shaft body detected by the first sensing control unit, and feed back the position information to the second sensing control units in an auxiliary slope central station and a next level of auxiliary slope central station that are correspondingly connected, and the transfer transportation device running in the arc-shaped shaft body is allowed to pass through the level of auxiliary slope central station after passage confirmation commands of the second sensing control units in the two levels are received, to implement synchronous staggered meeting of the transfer transportation devices in the upper straight shaft body and the lower straight shaft body that are adjacent; and an auxiliary slope bottom, where a second parking position is disposed at the auxiliary slope bottom, allowing parking of a particular quantity of transfer transportation devices to be run; and the $N^{th}$-level lower auxiliary slope body is in communication with the auxiliary slope bottom.

Further, the transfer transportation device further includes a monorail crane line, a front coupled locomotive and a rear coupled locomotive that are located in front of and behind the monorail crane line, and an electric locomotive robot; the front coupled locomotive and the rear coupled locomotive respectively pull the monorail crane line to move upward and downward; the first sensing control unit is integrated in the electric locomotive robot; and the electric locomotive robot receives operation of an external control unit to control start/stop/upward movement/downward movement of the monorail crane line.

Further, a car arresting apparatus is integrated inside the arc-shaped shaft body, and is configured to restrict the transfer transportation device running in the arc-shaped shaft body from continuing to run before the passage confirmation commands sent by the second sensing control units are received.

Further, a fourth sensing control unit is integrated in the auxiliary slope mouth, and is configured to: acquire position information of the transfer transportation device in the first-level upper auxiliary slope body and an adjacent arc-shaped shaft body, and restrict departure when it is confirmed that a locomotive is present inside.

Further, a fifth sensing control unit is integrated in the auxiliary slope bottom, and is configured to: acquire position information of the transfer transportation device in the $N^{th}$-level upper auxiliary slope body and an adjacent arc-shaped shaft body, and restrict departure when it is confirmed that a locomotive is present inside.

Further, each of the electric locomotive robot and the first, second, and third sensing control units includes a GPS module; and the GPS module is connected to an underground Zigbee wireless module by a circuit to be connected to an aboveground Zigbee wireless module, a gateway, and a base station to transmit a signal.

Another technical objective of the present application is to provide a control method of the auxiliary transportation system for a diesel engine monorail crane locomotive in a slope, including: controlling transfer scheduling among an area of an auxiliary slope mouth, a first-level upper auxiliary slope body, and an area of an adjacent arc-shaped shaft body through coordination; controlling transfer scheduling among an auxiliary slope bottom, an $N^{th}$-level lower auxiliary slope body, and an area of an adjacent arc-shaped shaft body through coordination; and controlling transfer scheduling between the first-level to an $N^{th}$-level upper auxiliary slope bodies and an area of the first-level to the $N^{th}$-level lower auxiliary slope bodies through coordination.

Further, the controlling transfer scheduling among an area of an auxiliary slope mouth, a first-level upper auxiliary slope body, and an area of an adjacent arc-shaped shaft body through coordination specifically includes: after a fourth sensing control unit senses a signal of a first sensing control unit on a transfer transportation device running in the first-level upper auxiliary slope body and the area of the adjacent arc-shaped shaft body, indicating that a monorail crane track in the area is in a full-load state, in this case, restricting departure from continuing in the area of the auxiliary slope mouth.

Further, the controlling transfer scheduling among an auxiliary slope bottom, an $N^{th}$-level lower auxiliary slope body, and an area of an adjacent arc-shaped shaft body through coordination specifically includes: after a fifth sensing control unit senses a signal of a first sensing control unit on a transfer transportation device running in the first-level upper auxiliary slope body and the area of the adjacent arc-shaped shaft body, indicating that a monorail crane track in the area is in a full-load state, in this case, restricting departure from continuing in an area of the auxiliary slope bottom.

Further, the controlling transfer scheduling between the first-level to an $N^{th}$-level upper auxiliary slope bodies and an area of the first-level to the $N^{th}$-level lower auxiliary slope bodies through coordination specifically includes: after a third sensing control unit in a connected arc-shaped shaft body receives passage confirmation commands sent by second sensing control units in an auxiliary slope central station and a next level of auxiliary slope central station that are correspondingly connected, allowing a transfer transportation device running in the arc-shaped shaft body to pass the level of auxiliary slope central station, and when the passage confirmation commands are not received, indicating that a locomotive is present in or a locomotive is about to enter the level of lower auxiliary slope body, restricting, through a car arresting apparatus, the transfer transportation device running in the arc-shaped shaft body from continuing to run.

Compared with the prior art, the advantages of the present application are as follows: For an auxiliary transportation system for a diesel engine monorail crane locomotive in a slope and a control method thereof designed in the present application, at most a plurality of transfer transportation devices can run simultaneously in an auxiliary slope body, to implement simultaneous upward or downward transportation of the plurality of transfer transportation devices. Compared with conventional monorail crane locomotive transportation, the applicability is higher, a large volume can be easily kept, scheduling and transportation efficiency is improved, and a requirement of a large transportation volume of materials in slope bodies is greatly met. In addition, in the auxiliary transportation system for a diesel engine monorail crane locomotive in a slope, an auxiliary slope central station is added, there are no rope breakage and slippage risks and brake system situations, and the safety is higher. Under the conditions of keeping equivalent economic benefits, compared with a gentle slope trackless rubber tyre vehicle transportation system, the period of mine construction is greatly shortened, and enterprise costs are reduced.

Where:

1—roadway, 2—transfer transportation device,

1-1—auxiliary slope mouth, 1-2—first parking position, 1-3—upper straight shaft body, 1-4—lower straight shaft body, 1-5—straight crossover shaft body, 1-6—second sensing control unit, 1-7—arc-shaped shaft body, 1-8—third sensing control unit, 1-9—auxiliary slope bottom, 1-10—car arresting apparatus, 1-11—fourth sensing control unit, 1-12—fifth sensing control unit, 1-13—second parking position,

2-1—fourth sensing control unit, 2-2—monorail crane line, 2-3—front coupled locomotive, 2-4—rear coupled locomotive, 2-5—electric locomotive robot.

DETAILED DESCRIPTION

Below, to enable a person skilled in the art to understand the technical solutions of the present application, further description is provided with reference to the accompanying drawings. It should be understood that these descriptions are merely exemplary and are not intended to limit the scope of the present application.

In the following detailed description, for ease of explanation, many specific details are described to provide comprehensive understanding of the embodiments of the present application. However, clearly, one or more embodiments can also be implemented without these specific details. In addition, in the following description, descriptions of well-known structures and techniques are omitted to avoid unnecessary confusion of the concepts of the present application.

Figure 2:
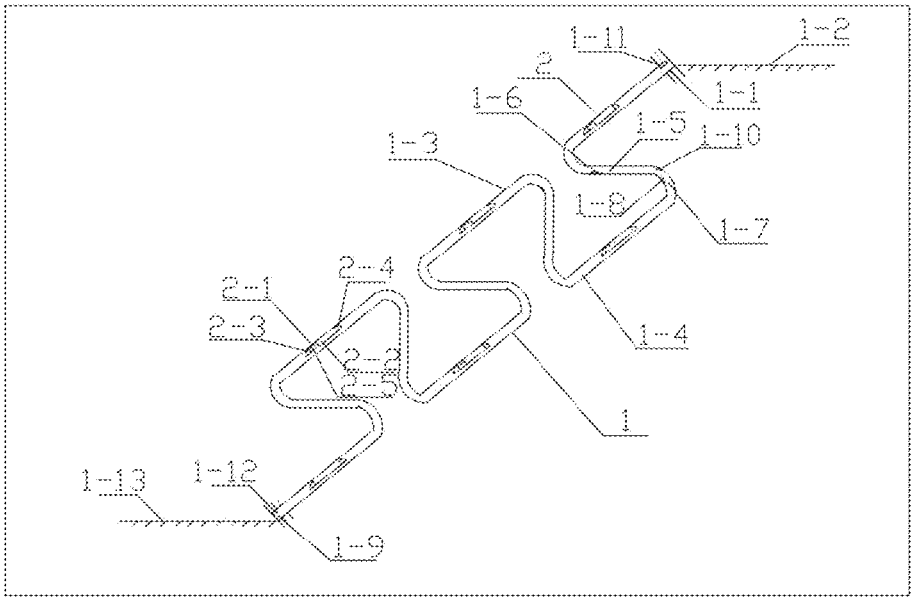
FIG. 2 is an overall schematic structural diagram of an auxiliary transportation system for a diesel engine monorail crane locomotive in a slope according to the present application.

FIG. 2 is an overall schematic structural diagram of an auxiliary transportation system for a diesel engine monorail crane locomotive in a slope according to the present application. The system includes a roadway 1 and a transfer transportation device 2. A monorail crane track is arranged at a top end of the roadway 1. The transfer transportation device 2 runs on the monorail crane track, and a first sensing control unit 2-1 is integrated in the transfer transportation device 2. In this embodiment, a diesel engine monorail crane locomotive is used for the transfer transportation device. Slope body stages are arranged with respect to different centerlines. Adjacent shaft body stages are linked by a horizontal central station. A plurality of diesel engine monorail crane locomotives in the shaft body may simultaneously run in the shaft body stages.

During specific implementation, the roadway 1 is disposed to include an auxiliary slope mouth 1-1. A first parking position 1-2 is disposed at the auxiliary slope mouth 1-1, allowing parking of a particular quantity of transfer transportation devices 2 to be run.

The roadway 1 includes the first-level to an $N^{th}$-level upper auxiliary slope bodies. 5 levels are used as an example in this embodiment. During specific implementation, combined mining may be performed according to a mine shaft depth. The levels of upper auxiliary slope bodies are arranged in stages, and each level of upper auxiliary slope body has an upper straight shaft body 1-3. The upper straight shaft body 1-3 has a gradient of 12° to 15° relative to a horizontal plane. Only one line of transfer transportation devices 2 are allowed to pass upward or downward inside the upper straight shaft body. The first-level upper straight shaft body 1-3 is in communication with the auxiliary slope mouth 1-1.

The roadway 1 includes the first-level to an $N^{th}$-level lower auxiliary slope bodies. 5 levels are also used as an example in this embodiment. The levels of lower auxiliary slope bodies are arranged in stages, and each level of lower auxiliary slope body has a lower straight shaft body 1-4, where the lower straight shaft body is spatially parallel to the upper straight shaft body 1-3, each level of lower straight shaft body 1-4 is arranged in a staggered manner obliquely below a corresponding level of upper straight shaft body 1-3, and only one line of transfer transportation devices are allowed to pass downward or upward inside the lower straight shaft body 1-4.

The roadway includes the first-level to an $N^{th}$-level auxiliary slope central stations, configured to schedule transfer transportation devices in upper and lower levels of slope bodies, to implement transportation of cargo between upper and lower levels. 5 levels are used as an example in this embodiment. Each level of auxiliary slope central station has a straight crossover shaft body 1-5 allowing two lines of transfer transportation devices that are staggered upward and downward to pass simultaneously, where each level of straight crossover shaft body 1-5 is located between a level of upper straight shaft body 1-3 and a level of lower straight shaft body 1-4 that are adjacent and between the lower straight shaft body 1-4 and a next level of upper straight shaft body 1-3 that are adjacent; and a second sensing control unit 1-6 is integrated inside each level of straight crossover shaft body 1-5.

The roadway includes a plurality of arc-shaped shaft bodies 1-7, connected between an auxiliary slope central station and an upper straight shaft body 1-3 and between an auxiliary slope central station and a lower straight shaft body 1-4 that are adjacent, so that the upper straight shaft body 1-3, the auxiliary slope central station, and the lower straight shaft body 1-4 that are adjacent form a spatially Z-shaped or inverted Z-shaped arrangement, and as shown in the figure, a pair of auxiliary slope central stations connected to two sides of each level of upper straight shaft body 1-3 or lower straight shaft body 1-4 are spatially arranged in a centrosymmetric structure with the corresponding upper straight shaft body 1-3 or lower straight shaft body 1-4 as a center.

In this embodiment, a third sensing control unit 1-8 is integrated inside each arc-shaped shaft body 1-7, and is configured to: sense position information of the transfer transportation device 2 running inside the arc-shaped shaft body detected by the first sensing control unit 2-1, and feed back the position information to the second sensing control units 1-6 in an auxiliary slope central station and a next level of auxiliary slope central station that are correspondingly connected, and the transfer transportation device running in the arc-shaped shaft body is allowed to pass through the level of auxiliary slope central station after passage confirmation commands of the second sensing control units 1-6 in the two levels are received, to implement synchronous staggered meeting of the transfer transportation devices in the upper straight shaft body and the lower straight shaft body that are adjacent, thereby ensuring that one transfer transportation device is always kept in the upper straight shaft body 1-3 and the lower straight shaft body 1-4.

The roadway includes an auxiliary slope bottom 1-9, where a second parking position 1-13 is disposed at the auxiliary slope bottom 1-9, allowing parking of a particular quantity of transfer transportation devices 2 to be run, and the $N^{th}$-level lower auxiliary slope body is in communication with the auxiliary slope bottom 1-9.

As shown in the figure, during specific implementation, the transfer transportation device 2 further includes a monorail crane line 2-2, a front coupled locomotive 2-3 and a rear coupled locomotive 2-4 that are located in front of and behind the monorail crane line 2-2, and an electric locomotive robot 2-5; the front coupled locomotive 2-3 and the rear coupled locomotive 2-4 respectively pull the monorail crane line 2-2 to move upward and downward, that is, one same locomotive line can move both upward and downward in the shaft body without turning around. The first sensing control unit 2-1 is integrated in the electric locomotive robot 2-5;

and the electric locomotive robot 2-5 receives operation of an external control unit to control start/stop/upward movement/downward movement of the monorail crane line 2-2.

During specific implementation, a car arresting apparatus 1-10, that is, a brake apparatus, is integrated inside the arc-shaped shaft body 1-7, and is configured to restrict the transfer transportation device 2 running in the arc-shaped shaft body from continuing to run before the passage confirmation commands sent by the second sensing control units 1-6 are received.

In addition, a fourth sensing control unit 1-11 is integrated in the auxiliary slope mouth 1-1, and is configured to: acquire position information of the transfer transportation device 2 in the first-level upper auxiliary slope body and an adjacent arc-shaped shaft body 1-7, and restrict departure when it is confirmed that a locomotive is present inside. A fifth sensing control unit 1-12 is integrated in the auxiliary slope bottom 1-9, and is configured to: acquire position information of the transfer transportation device 2 in the $N^{th}$-level upper auxiliary slope body and an adjacent arc-shaped shaft body 1-7, and restrict departure when it is confirmed that a locomotive is present inside, thereby keeping ensuring that one transfer transportation device 2 is always kept in the upper straight shaft body 1-3 and the lower straight shaft body 1-4.

Each of the electric locomotive robot and the first, second, and third sensing control units in this embodiment includes a GPS module; and the GPS module is connected to an underground Zigbee wireless module by a circuit to be connected to an aboveground Zigbee wireless module, a gateway, and a base station to transmit a signal. During specific implementation, another signal transmission module may be used, to implement a network connection.

In addition, this embodiment further provides a control method of the auxiliary transportation system for a diesel engine monorail crane locomotive in a slope, including: controlling transfer scheduling among an area of an auxiliary slope mouth, a first-level upper auxiliary slope body, and an area of an adjacent arc-shaped shaft body through coordination; controlling transfer scheduling among an auxiliary slope bottom, an $N^{th}$-level lower auxiliary slope body, and an area of an adjacent arc-shaped shaft body through coordination; and controlling transfer scheduling between the first-level to an $N^{th}$-level upper auxiliary slope bodies and an area of the first-level to the $N^{th}$-level lower auxiliary slope bodies through coordination.

During specific implementation, the controlling transfer scheduling among an area of an auxiliary slope mouth, a first-level upper auxiliary slope body, and an area of an adjacent arc-shaped shaft body through coordination specifically includes: after a fourth sensing control unit 1-11 senses a signal of a first sensing control unit 2-1 on a transfer transportation device running in the first-level upper auxiliary slope body and the area of the adjacent arc-shaped shaft body, indicating that a monorail crane track in the area is in a full-load state, in this case, restricting departure from continuing in the area of the auxiliary slope mouth 1-1.

The controlling transfer scheduling among an auxiliary slope bottom, an $N^{th}$-level lower auxiliary slope body, and an area of an adjacent arc-shaped shaft body through coordination specifically includes: after a fifth sensing control unit 1-12 senses a signal of a first sensing control unit on a transfer transportation device running in the first-level upper auxiliary slope body and the area of the adjacent arc-shaped shaft body, indicating that a monorail crane track in the area is in a full-load state, in this case, restricting departure from continuing in an area of the auxiliary slope bottom 1-9. The controlling transfer scheduling between the first-level to an $N^{th}$-level upper auxiliary slope bodies and an area of the first-level to the $N^{th}$-level lower auxiliary slope bodies through coordination specifically includes: after a third sensing control unit 1-8 in a connected arc-shaped shaft body 1-7 receives passage confirmation commands sent by second sensing control units in an auxiliary slope central station and a next level of auxiliary slope central station that are correspondingly connected, allowing a transfer transportation device running in the arc-shaped shaft body to pass the level of auxiliary slope central station, and when the passage confirmation commands are not received, indicating that a locomotive is present in or a locomotive is about to enter the level of lower auxiliary slope body, restricting, through a car arresting apparatus, the transfer transportation device running in the arc-shaped shaft body from continuing to run.

Figure 1:
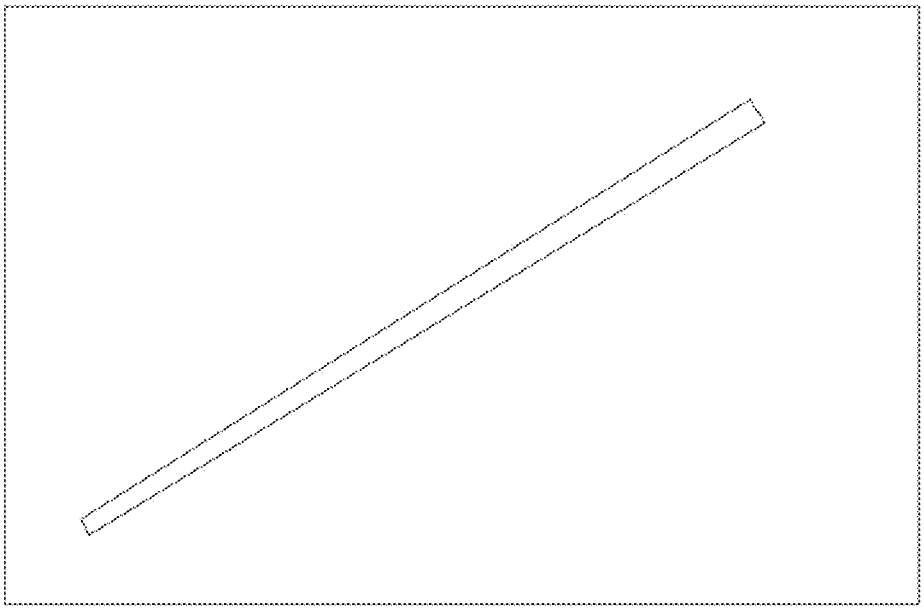
FIG. 1 is an overall schematic structural diagram of an underground auxiliary slope of an existing mine.

Compared with a conventional implementation solution of a slope provided in FIG. 1, for an auxiliary transportation system for a diesel engine monorail crane locomotive in a slope and a control method thereof designed in the present application, at most a plurality of transfer transportation devices can run simultaneously in an auxiliary slope body, to implement simultaneous upward or downward transportation of the plurality of transfer transportation devices. Compared with conventional monorail crane locomotive transportation, the applicability is higher, a large volume can be easily kept, scheduling and transportation efficiency is improved, and a requirement of a large transportation volume of materials in slope bodies is greatly met. In addition, in the auxiliary transportation system for a diesel engine monorail crane locomotive in a slope, an auxiliary slope central station is added, there are no rope breakage and slippage risks and brake system situations, and the safety is higher. Under the conditions of keeping equivalent economic benefits, compared with a gentle slope trackless rubber tyre vehicle transportation system, the period of mine construction is greatly shortened, and enterprise costs are reduced.

The foregoing embodiments are merely descriptions of preferred implementations of the present application and are not used to limit the scope of the present application. Various variations and improvements made by a person of ordinary skill in the art to the technical solutions of the present application without departing from the design spirit of the present application shall fall within the protection scope determined by the claims of the present application.

What is claimed is:

1. An auxiliary transportation system for a diesel engine monorail crane locomotive in a slope, comprising: a roadway, wherein a monorail crane track is arranged at a top end of the roadway; and a transfer transportation device, wherein the transfer transportation device runs on the monorail crane track, and a first sensing control unit is integrated in the transfer transportation device, wherein the roadway comprises:

an auxiliary slope mouth, wherein a first parking position is disposed at the auxiliary slope mouth, allowing parking of a particular quantity of transfer transportation devices to be run;

the first-level to an $N^{th}$-level upper auxiliary slope bodies, the levels of upper auxiliary slope bodies are arranged in stages, and each level of upper auxiliary slope body has:

an upper straight shaft body, wherein the upper straight shaft body has a gradient of 12° to 15° relative to a horizontal plane, only one line of transfer transportation devices are allowed to pass upward or downward inside the upper straight shaft body; and the first-level upper straight shaft body is in communication with the auxiliary slope mouth;

the first-level to an $N^{th}$-level lower auxiliary slope bodies, the levels of lower auxiliary slope bodies are arranged in stages, and each level of lower auxiliary slope body has:

a lower straight shaft body, wherein the lower straight shaft body is spatially parallel to the upper straight shaft body, each level of lower straight shaft body is arranged in a staggered manner obliquely below a corresponding level of upper straight shaft body, and only one line of transfer transportation devices are allowed to pass downward or upward inside the lower straight shaft body;

the first-level to an $N^{th}$-level auxiliary slope central stations, and each level of auxiliary slope central station has:

a straight crossover shaft body allowing two lines of transfer transportation devices that are staggered upward and downward to pass simultaneously, wherein each level of straight crossover shaft body is located between a level of upper straight shaft body and a level of lower straight shaft body that are adjacent and between the lower straight shaft body and a next level of upper straight shaft body that are adjacent; and a second sensing control unit is integrated inside each level of straight crossover shaft body;

a plurality of arc-shaped shaft bodies, connected between an auxiliary slope central station and an upper straight shaft body and between an auxiliary slope central station and a lower straight shaft body that are adjacent, so that the upper straight shaft body, the auxiliary slope central station, and the lower straight shaft body that are adjacent form a spatially Z-shaped or inverted Z-shaped arrangement, and a pair of auxiliary slope central stations connected to two sides of each level of upper straight shaft body or lower straight shaft body are spatially arranged in a centrosymmetric structure with the corresponding upper straight shaft body or lower straight shaft body as a center, wherein a third sensing control unit is integrated inside each arc-shaped shaft body, and is configured to: sense position information of the transfer transportation device running inside the arc-shaped shaft body and in the connected upper straight shaft body or lower straight shaft body detected by the first sensing control unit, and feed back the position information to the second sensing control units in an auxiliary slope central station and a next level of auxiliary slope central station that are correspondingly connected, and the transfer transportation device running in the arc-shaped shaft body is allowed to pass through the level of auxiliary slope central station after passage confirmation commands of the second sensing control units in the two levels are received, to implement synchronous staggered meeting of the transfer transportation devices in the upper straight shaft body and the lower straight shaft body that are adjacent; and an auxiliary slope bottom, wherein a second parking position is disposed at the auxiliary slope bottom, allowing parking of a particular quantity of transfer transportation devices to be run; and the $N^{th}$-level lower auxiliary slope body is in communication with the auxiliary slope bottom.

2. The auxiliary transportation system for a diesel engine monorail crane locomotive in a slope according to claim 1, wherein the transfer transportation device further comprises a monorail crane line, a front coupled locomotive and a rear coupled locomotive that are located in front of and behind the monorail crane line, and an electric locomotive robot; the front coupled locomotive and the rear coupled locomotive respectively pull the monorail crane line to move upward and downward; the first sensing control unit is integrated in the electric locomotive robot; and the electric locomotive robot receives operation of an external control unit to control start/stop/upward movement/downward movement of the monorail crane line.

3. The auxiliary transportation system for a diesel engine monorail crane locomotive in a slope according to claim 2, wherein a car arresting apparatus is integrated inside the arc-shaped shaft body, and is configured to restrict the transfer transportation device running in the arc-shaped shaft body from continuing to run before the passage confirmation commands sent by the second sensing control units are received.

4. The auxiliary transportation system for a diesel engine monorail crane locomotive in a slope according to claim 3, wherein a fourth sensing control unit is integrated in the auxiliary slope mouth, and is configured to: acquire position information of the transfer transportation device in the first-level upper auxiliary slope body and an adjacent arc-shaped shaft body, and restrict departure when it is confirmed that a locomotive is present inside.

5. The auxiliary transportation system for a diesel engine monorail crane locomotive in a slope according to claim 4, wherein a fifth sensing control unit is integrated in the auxiliary slope bottom, and is configured to: acquire position information of the transfer transportation device in the $N^{th}$-level upper auxiliary slope body and an adjacent arc-shaped shaft body, and restrict departure when it is confirmed that a locomotive is present inside.

6. The auxiliary transportation system for a diesel engine monorail crane locomotive in a slope according to claim 5, wherein each of the electric locomotive robot and the first, second, and third sensing control units comprises a GPS module; and the GPS module is connected to an underground Zigbee wireless module by a circuit to be connected to an aboveground Zigbee wireless module, a gateway, and a base station to transmit a signal.

7. A control method of the auxiliary transportation system for a diesel engine monorail crane locomotive in a slope according to claim 1, comprising: controlling transfer scheduling among an area of an auxiliary slope mouth, a first-level upper auxiliary slope body, and an area of an adjacent arc-shaped shaft body through coordination; controlling transfer scheduling among an auxiliary slope bottom, an $N^{th}$-level lower auxiliary slope body, and an area of an adjacent arc-shaped shaft body through coordination; and controlling transfer scheduling between the first-level to an $N^{th}$-level upper auxiliary slope bodies and an area of the first-level to the $N^{th}$-level lower auxiliary slope bodies through coordination.

8. The control method of the auxiliary transportation system for a diesel engine monorail crane locomotive in a slope according to claim 7, wherein the controlling transfer scheduling among an area of an auxiliary slope mouth, a first-level upper auxiliary slope body, and an area of an adjacent arc-shaped shaft body through coordination specifically comprises: after a fourth sensing control unit senses a signal of a first sensing control unit on a transfer transportation device running in the first-level upper auxiliary slope body and the area of the adjacent arc-shaped shaft body, indicating that a monorail crane track in the area is in a full-load state, in this case, restricting departure from continuing in the area of the auxiliary slope mouth.

9. The control method of the auxiliary transportation system for a diesel engine monorail crane locomotive in a slope according to claim 7, wherein the controlling transfer scheduling among an auxiliary slope bottom, an $N^{th}$-level lower auxiliary slope body, and an area of an adjacent arc-shaped shaft body through coordination specifically comprises: after a fifth sensing control unit senses a signal of a first sensing control unit on a transfer transportation device running in the first-level upper auxiliary slope body and the area of the adjacent arc-shaped shaft body, indicating that a monorail crane track in the area is in a full-load state, in this case, restricting departure from continuing in an area of the auxiliary slope bottom.

10. The control method of the auxiliary transportation system for a diesel engine monorail crane locomotive in a slope according to claim 7, wherein the controlling transfer scheduling between the first-level to an $N^{th}$-level upper auxiliary slope bodies and an area of the first-level to the $N^{th}$-level lower auxiliary slope bodies through coordination specifically comprises: after a third sensing control unit in a connected arc-shaped shaft body receives passage confirmation commands sent by second sensing control units in an auxiliary slope central station and a next level of auxiliary slope central station that are correspondingly connected, allowing a transfer transportation device running in the arc-shaped shaft body to pass the level of auxiliary slope central station, and when the passage confirmation commands are not received, indicating that a locomotive is present in or a locomotive is about to enter the level of lower auxiliary slope body, restricting, through a car arresting apparatus, the transfer transportation device running in the arc-shaped shaft body from continuing to run.

* * * * *